US006202866B1

(12) United States Patent
Shea

(10) Patent No.: US 6,202,866 B1
(45) **Date of Patent: *Mar. 20, 2001**

(54) MECHANDISING DISPLAY ASSEMBLY INCORPORATING A SWINGING PLANAR DISPLAY MEMBER

(76) Inventor: Thomas M. Shea, 1343 Rochester Rd., Suite 100, Troy, MI (US) 48083

( * ) Notice: Subject to any disclaimer, the term of this patent is extended or adjusted under 35 U.S.C. 154(b) by 0 days.

This patent is subject to a terminal disclaimer.

(21) Appl. No.: 09/280,285

(22) Filed: Mar. 29, 1999

Related U.S. Application Data

(63) Continuation-in-part of application No. 09/225,671, filed on Jan. 5, 1999, now Pat. No. 6,070,747, and a continuation-in-part of application No. 08/888,558, filed on Jul. 7, 1997, now Pat. No. 5,957,422.

(51) Int. Cl.[7] ..... A47F 5/00

(52) U.S. Cl. ..... 211/87.01; 211/59.1; 211/113; 211/103

(58) Field of Search ..... 211/87.01, 103, 211/59.1, 57.1, 113, 105.3, 105.1

(56) References Cited

U.S. PATENT DOCUMENTS

| | | | | |
|---|---|---|---|---|
| D. 320,719 | | 10/1991 | Kolsrud et al. . | |
| D. 327,187 | | 6/1992 | Swon . | |
| 431,110 | | 7/1890 | Driver . | |
| 2,020,991 | | 11/1935 | Brody . | |
| 2,935,210 | | 5/1960 | Cohen . | |
| 3,018,898 | | 1/1962 | Frazelle . | |
| 3,087,624 | | 4/1963 | Hucker . | |
| 3,200,960 | * | 8/1965 | Banse | 211/59.1 |
| 3,221,893 | | 12/1965 | Glaberson et al. . | |
| 3,513,606 | | 5/1970 | Jones . | |
| 3,677,415 | | 7/1972 | Radek . | |
| 3,935,357 | | 1/1975 | Padovani . | |
| 4,159,814 | | 7/1979 | Fibus . | |
| 4,286,006 | | 8/1981 | Boelter . | |
| 4,461,443 | | 7/1984 | Dauman . | |
| 4,629,075 | | 12/1986 | Hutten . | |
| 4,718,627 | | 1/1988 | Fast et al. . | |
| 4,720,016 | | 1/1988 | Kay . | |
| 4,767,012 | | 8/1988 | Simmons . | |
| 4,770,303 | * | 9/1988 | Boyd | 211/118 X |
| 4,911,392 | | 3/1990 | Fast . | |
| 4,919,280 | | 4/1990 | Phillips . | |
| 5,090,725 | | 2/1992 | Feldner . | |
| 5,096,070 | | 3/1992 | Jaynes . | |
| 5,269,408 | * | 12/1993 | Otis et al. | 211/113 X |
| 5,284,259 | | 2/1994 | Conway et al. . | |
| 5,370,249 | | 12/1994 | Harvey et al. . | |

(List continued on next page.)

FOREIGN PATENT DOCUMENTS

| | | |
|---|---|---|
| 251351 | 4/1926 | (GB) . |

*Primary Examiner*—Robert W. Gibson, Jr.
(74) *Attorney, Agent, or Firm*—Gifford, Krass, Groh, Sprinkle, Anderson & Citkowski, P.C.

(57) ABSTRACT

A merchandising display assembly mounted to and extending from an upwardly extending support surface, the support surface having an elongate and single slotted backplate with a plurality of spaced apart and linearly extending slots. A horizontally extending member is mounted to and extends from the support surface. The horizontally extending member in one specific embodiment includes first and second elongated portions and axially adjusting means for establishing a length between the elongated portions and in a further embodiment is formed by a single fixed and extending portion. An elongated display member is secured to an outer end of the a horizontal member in freely swinging and suspended fashion and extends in parallel fashion relative to the vertical support surface at a spaced distance. The display member exhibits a substantially flattened display area for securing thereon a plurality of hanger portions which are in turn capable of supporting large volumes of small sized merchandise without obscuring additional merchandise located on the vertical support surface.

15 Claims, 10 Drawing Sheets

U.S. PATENT DOCUMENTS

| | | | |
|---|---|---|---|
| 5,386,916 | | 2/1995 | Valiulis . |
| 5,405,022 | | 4/1995 | Rissley . |
| 5,415,370 | | 5/1995 | Valiulis . |
| 5,443,167 | | 8/1995 | Menaged et al. . |
| 5,505,318 | | 4/1996 | Goff . |
| 5,505,319 | | 4/1996 | Todd, Jr. . |
| 5,526,944 | | 6/1996 | Merl . |
| 5,547,088 | | 8/1996 | Belokin et al. . |
| 5,553,721 | | 9/1996 | Gebka . |
| 5,556,064 | | 9/1996 | Cowe . |
| 5,620,104 | | 4/1997 | Maglione . |
| 5,657,884 | | 8/1997 | Zilincar, III . |
| 5,660,286 | | 8/1997 | Shea . |
| 5,678,702 | | 10/1997 | Menaged et al. . |
| 5,762,207 | | 6/1998 | Maglione . |
| 5,833,181 | * | 11/1998 | DesNoyers . |
| 5,957,422 | * | 9/1999 | Shea ..... 211/87.01 X |
| 6,070,747 | * | 6/2000 | Shea ..... 211/87.01 |

* cited by examiner

MECHANDISING DISPLAY ASSEMBLY INCORPORATING A SWINGING PLANAR DISPLAY MEMBER

CROSS REFERENCE TO COPENDING APPLICATIONS

The present application is a continuation-in-part of U.S. application Ser. No. 09/225,671, filed Jan. 5, 1999, now U.S. Pat. No. 6,070,747 for a Merchandising Display Structure, as well as a continuation-in-part of U.S. application Ser. No. 08/888,558, filed Jul. 7, 1997, now U.S. Pat. No. 5,957,422 for a Reinforced Strip Display Assembly Capable of Supporting High Volumes of Smaller Impulse Merchandise.

BACKGROUND OF THE INVENTION

1. Field of the Invention

The present invention relates generally to merchandising display assemblies and, more particularly, to a merchandising display assembly mounted to and extending from an upwardly extending support surface and which includes an elongated and substantially flattened or planar display surface area attached in a freely swinging manner to a single upper horizontally extending members and being spaced a distance from the vertical support, the display surface area being capable of supporting volumes of smaller sized merchandise.

2. Description of the Prior Art

Shelving structures and related display units for displaying merchandise are a common sight in any type of store or commercial establishment. The desire of any merchant is and always has been to maximize the available shelf or display capacity within the limited confines of the store. Vertically extending pegboard surfaces are particularly effective for displaying small, high volume merchandise on hooks and other horizontally extending fasteners.

U.S. Pat. No. 3,677,415, issued to Radek, teaches a cantilever merchandise support including an article supporting hanger bar or bracket which is adapted to be attached to a perforated board or panel by a plurality of legs extending from a mounting plate. The hanger bar or bracket portion is in each instance an integrally formed single piece which is mounted to extend outwardly from the vertical surface and upon which the merchandise is supported. The disadvantage of cantilevered merchandise supports such as those taught by Radek is that their merchandise carrying capacity is limited to the bar or bracket portion. The axial length which such supports extend is likewise limited such that they are unable to utilize to any great extent the air space extending from the pegboard or other surface for displaying merchandise.

U.S. Pat. No. 5,014,954, issued to Merl, discloses an adjustable display arm assembly securable to a vertical support structure which includes a pair of nesting segments selectively adjustable at longitudinal positions to establish an overall length of the display arm. The Merl device is somewhat of an improvement over Radek in that the display arm can be extended outward a greater horizontal distance, however its merchandise carrying ability is still limited to the display arm itself and it does not include any additional bracketry for carrying large volumes of merchandise.

Applicant's preceding application Ser. No. 08/888,558, filed Jul. 7, 1997, discloses a reinforced strip display assembly which is capable of supporting high volumes of smaller impulse merchandise and which includes an elongate and planar shaped reinforced body which is suspended in a freely swinging manner from a horizontally extending upper bracket. The reinforced body includes a plurality of apertures formed in front and rear planar faces and which are capable of receiving individual merchandise support members. The bracket further includes one or more hook portions which engage the upper end of the elongate body to array the body in its freely suspended manner a spaced distance from the shelving construction.

Applicant's preceding application Ser. No. 09/225,671, filed Jan. 5, 1999, discloses a merchandising display structure mounted to a vertical support surface and including at least one horizontally extending and adjustable member which is secured at one end to the vertical support surface and which at the opposite end supports an elongate and substantially flattened display member. The display member includes receiving means at spaced intervals therealong for receiving a volume of merchandise. According to alternate preferred embodiments, the display member can further include first and second parallel spaced grid patterns of interlocking wire elements which establish first and second faces. The display member may also include an elongated and substantially flattened sheet of material, such as a durable polymer construction and having disposed therein a large plurality of apertures at spaced intervals.

SUMMARY OF THE PRESENT INVENTION

The present invention is a merchandising display assembly which may be mounted to an upwardly extending support surface, the support surface being of a number of different conventionally known supporting surfaces such as single slotted and vertically extending backplate surfaces, pegboard surfaces having a number of apertures formed therethrough horizontal extending shelving display surfaces and the like. A single horizontally extending member is provided and includes in one embodiment first and second elongated portions which are axially adjustable to modify the overall length of the arm. According to a further embodiment, the horizontally extending member is fixed. A support surface engaging portion is attached to a free end of the horizontal member and is suitable for engaging with a singled slotted and vertically extending bracket for mounting the member in a horizontally extending fashion relative the vertical surface.

An elongated display member is provided in the form of an elongated and substantially flattened display surface area and is suspended in a freely swinging fashion to an opposite end of the horizontally extending member by hooks or the like. According to a first preferred variant, the display surface area includes a planar shaped grid pattern of interlocking elements defining first and second sides of the display. According to a further variant, the flattened display surface area includes a flattened display board through which is formed a large plurality of spaced apertures formed along the length of the display board at spaced apart intervals.

In either variant, hooks or other conventional hangers are capable of being releasably secured for supporting large volumes of small sized packaged merchandise. The advantage of the display assembly is that it can support a relatively large volume of small, high volume merchandise a spaced distance from the pegboard or other vertical surface without obscuring other additional items displayed on the vertical board or shelf surface. The overall advantage of the present invention is that it greatly increases the merchandise display capacity of such a conventional display structure by utilizing to a much greater extent the unused air space in the area in front of the display surface.

BRIEF DESCRIPTION OF THE DRAWING

Reference will now be made to the attached drawing, when read in combination with the following description of the preferred embodiments, wherein like reference numerals refer to like parts throughout the several views, and in which.

DETAILED DESCRIPTION OF THE PREFERRED EMBODIMENTS

Figure 1:
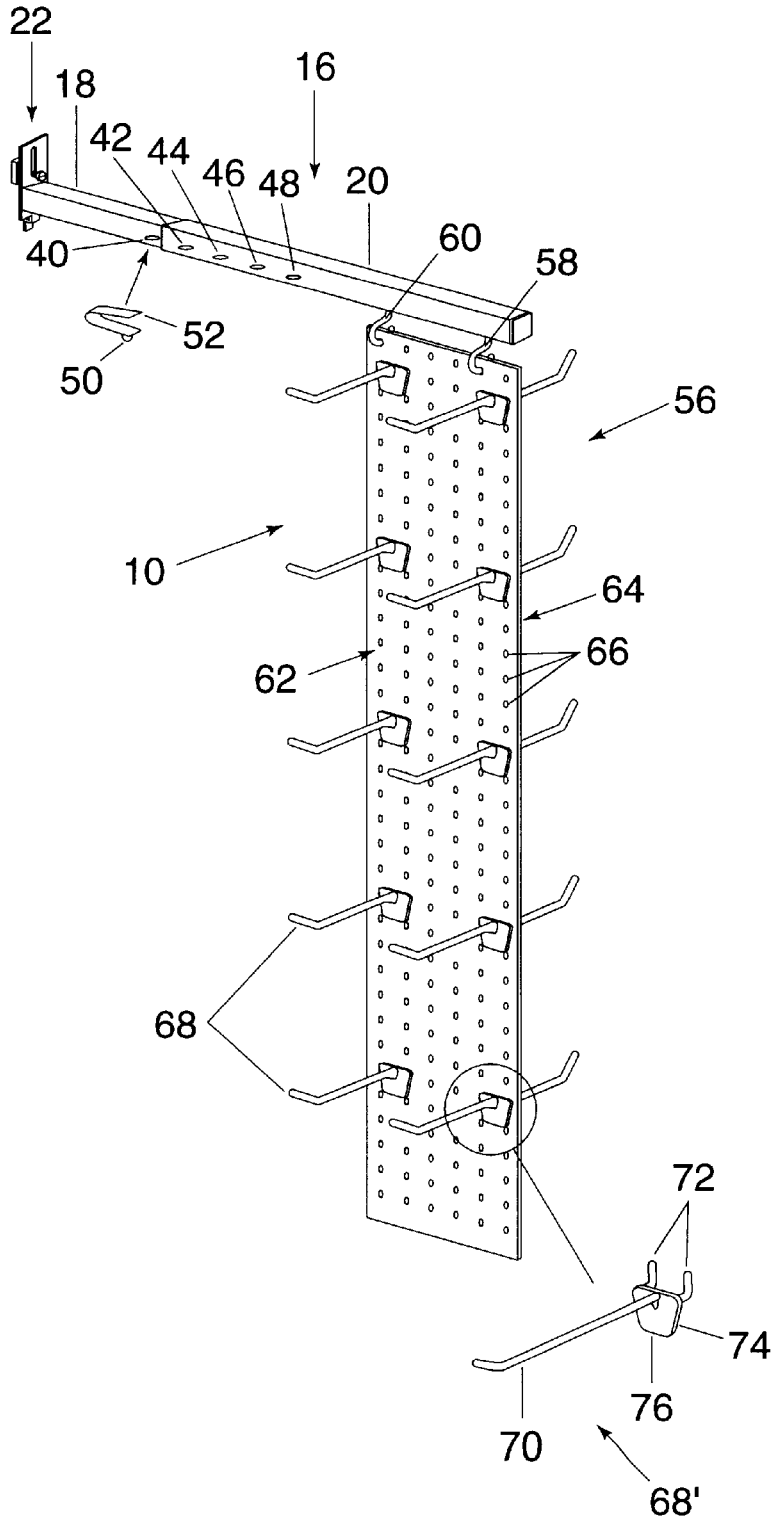
FIG. 1 is a perspective view of a merchandising display assembly according to a first preferred embodiment of the present invention and illustrating a telescoping horizontally extending member and a suspended and freely swinging display member constructed of a substantially solid material.
Figure 15:
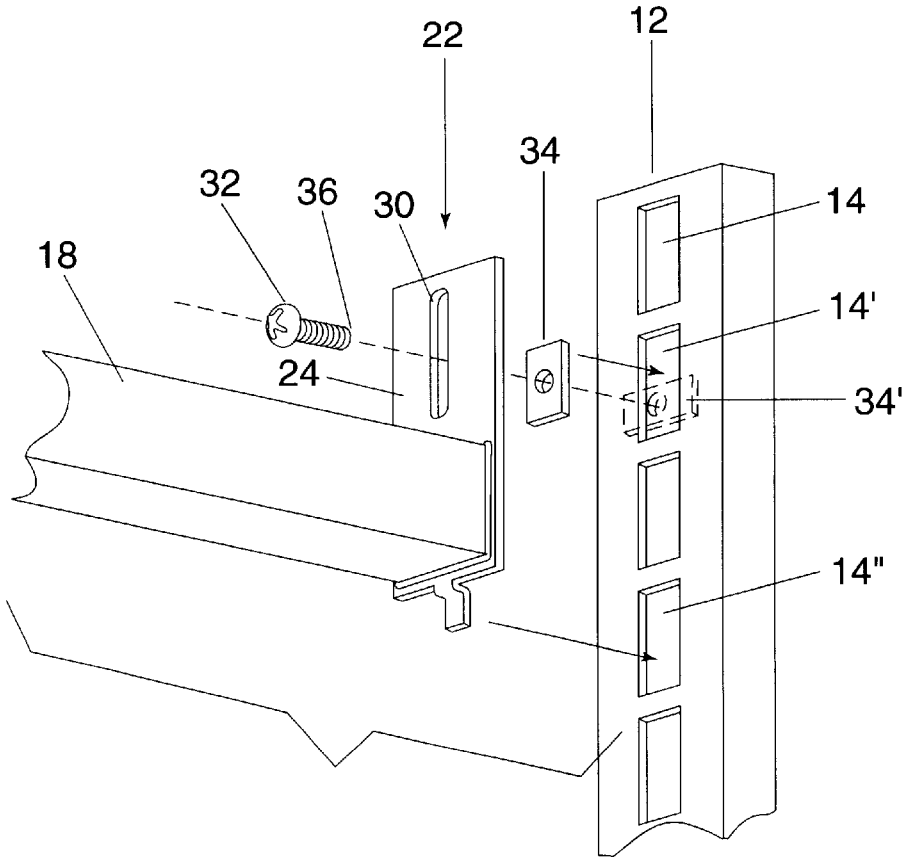
FIG. 15 is an exploded view in section of a support surface engaging portion for use with the merchandising display structure according to the present invention.

Referring now to FIG. 1, a merchandising display assembly 10 is shown mounted to a vertical support surface 12 (as is further illustrated in FIG. 15) and which is provided as an elongate single slotted backplate having a plurality of spaced apart and linearly extending slots 14. The vertical support surface in other conventional embodiments may typically also include a holed pegboard type surface upon which volumes of small merchandise are displayed using hooks or hangers but can also be provided by any other surface such as a vertical face of a horizontal shelving support or the face of a vertically or horizontally extending support of such a shelving support. The advantages of utilizing the merchandising display assembly according to the present invention with the various kinds of conventional shelving displays will be subsequently described.

Referring again to FIG. 1, the merchandising display assembly 10 includes a single horizontally extending member 16 having a first elongated portion 18 and a second elongated portion 20. The extending member 16 extends from the vertical support surface 12 by means of a support portion 22. Referring again to the enlarged view of FIG. 5, the support portion 22 is again illustrated and includes a plate shaped member 24 connected to an end 26 of the first elongated portion 18, preferably by welding. A downwardly and forwardly stepped portion 28 extends from a bottom edge of the plate shaped member 24. A means for mounting the support portion 22 to the slotted backplate 12 further includes a vertical slotted portion 30 formed along a predetermined length of the planar shaped member 24. A screw 32 projects through the slotted portion 30 and a first selected linearly extending slot 14' of the backplate 12. A square shaped nut 34 sets upon a projecting end 36 of the screw 32 and is subsequently rotatable to a 90 degree position as shown in phantom at 34' upon being inserted within the hollow interior of the support portion 22 and upon seating the downwardly and forward stepped portion 28 within a further selected linearly extending slot 14" and so as to releasably secure the support portion to the vertical backplate.

Referring again to FIG. 1, the first elongated portion 18 forms an inner telescoping portion and the second elongated portion 20 forms an outer telescoping portion. The first and second elongate portions 18 and 20 are polygonal shaped in cross section and range from three sides, corresponding to a triangle, to an infinite number of sides corresponding to a circular cross section. Preferably however, the cross sectional configuration of the elongated or telescopic portions is rectangular.

An end of the inner telescoping portion which is opposite to the support portion 22 is received within an opposing end of the outer telescoping portion. A single aperture 40 (illustrated in phantom) is formed along a bottom facing surface of the rectangular cross section of the inner telescoping portion and is selectively and slidably aligned with one of a plurality of apertures 42, 44, 46 and 48 formed along a corresponding and overlapping face of the outer telescoping portion. The single aperture 40 of the first telescoping portion 18 is shown in FIG. 1 for purposes of illustration spaced from the plurality of apertures 42, 44, 46 and 48, however it being understood that the telescoping portions are coaxially adjusted so that the aperture 40 aligns with a selected one of the plurality of apertures.

An outwardly biasing spring-loaded pin 50 is inserted within the end of the inner telescoping portion so that an outwardly biasing button portion 52 of the pin 50 projects through the single aperture 40 and one of the associated apertures 42, 44, 46 and 48 of the overlapping outer tubular portion so as to readjust the overall length of the horizontal member in one of two directions along the directional arrow 54. This is accomplished simply by pressing the button portion 52 inwardly and then axially sliding the inner and outer telescoping members relative to one another until a desired aperture of the plurality of apertures aligns over the single aperture, at which point the button portion will again project upwardly through the apertures snapping the horizontal member in place. The use of the spring-loaded pin 50 with outwardly biasing button portion 52 is a further improvement over prior art telescoping assemblies which require extraneous threaded bolts and other removable fasteners which can be easily misplaced or lost in normal use.

An elongated and substantially flattened display member 56 is attached to a free end of the second elongated portion 20 (or outer tubular member) in freely suspended and swinging fashion. This is accomplished by first and second hooks 58 and 60 which extend from an underside surface of the second elongated portion 20 and which engage selected locations proximate to a top edge of the display member 56. According to the preferred embodiment of FIG. 1, the display member 56 is provided as first 62 and second 64 opposite faces defined by a substantially solid material (such as a polymer or possibly durable particle board or the like). A plurality of individual apertures 66 are formed through the solid material and between the first and second faces at selected intervals.

Hanger portions 68 are provided and are constructed in a fashion known in the art and, as is further illustrated in the specific hanger portion 68' indicated portion in FIG. 1, includes an elongate hanger 70 upon which is supported a plurality of smaller sized merchandising (not shown) as well as tab pairs (angled at 72 and straight at 74) which extend from a rear side of a plate portion 76 and which are engageable with selected apertures 66 formed in the display member 56.

Figure 2:
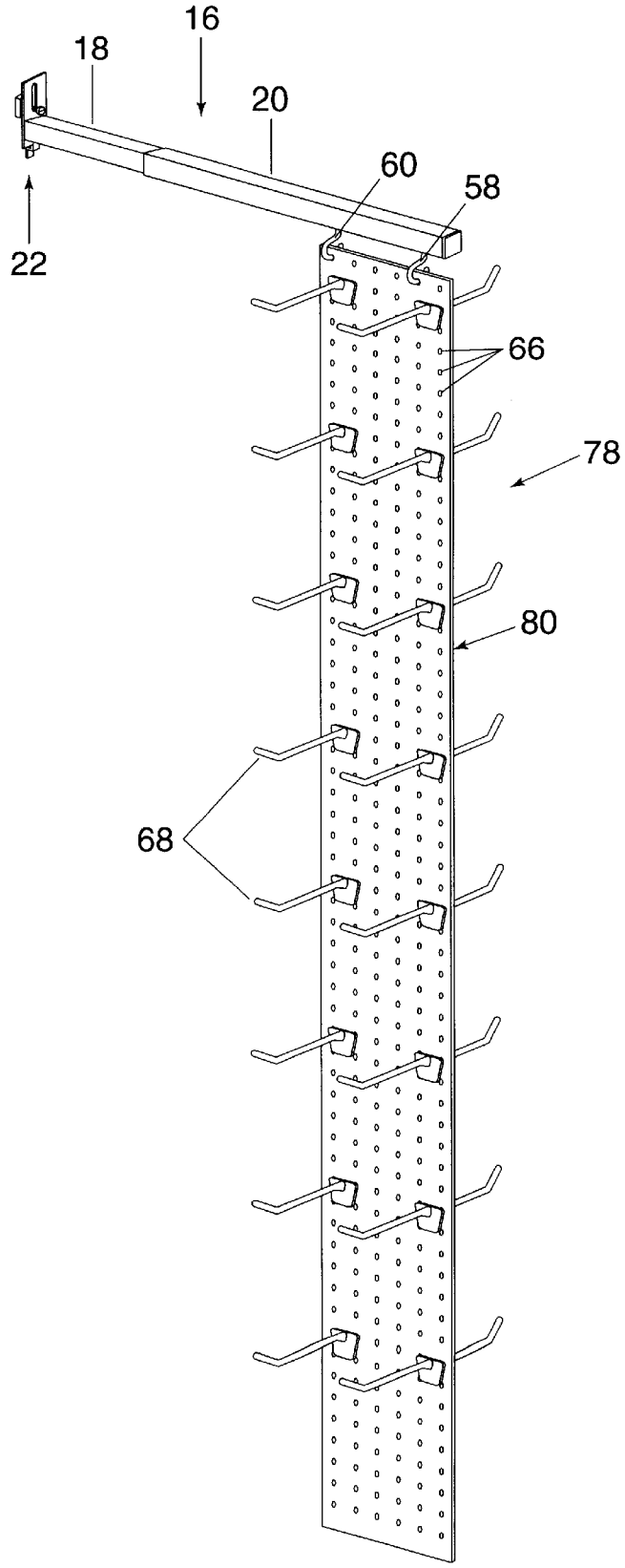
FIG. 2 is a variation of the first preferred embodiment and illustrating differently shaped display member according to the present invention.

Referring further to FIG. 2, a modification is shown at 78 of the merchandising display assembly according to the first preferred embodiment and which differs from the first embodiment 10 only in that a selected width of the display 56 is lengthened, at 80, in a horizontal direction. Aside from this, the remaining features of the modification 78 are all identical to the first embodiment 10 and include horizontal member 16 with first and second telescoping portions 18 and 20, support portion 22 for engaging with the vertical support surface 12, and hooks 58 and 60 extending from an underside of the second telescoping portion 20 for securing through selected apertures 66 located proximate the upper edge of the display member 78 for permitting the display member 78 to be freely swingable. Dual advantages of the swingable display member include the safety factor of the display member being movable in the event of a shopper running or bumping into the display member to prevent injury as well as the eye catching appeal of the swinging display to lure shoppers.

Figure 3:
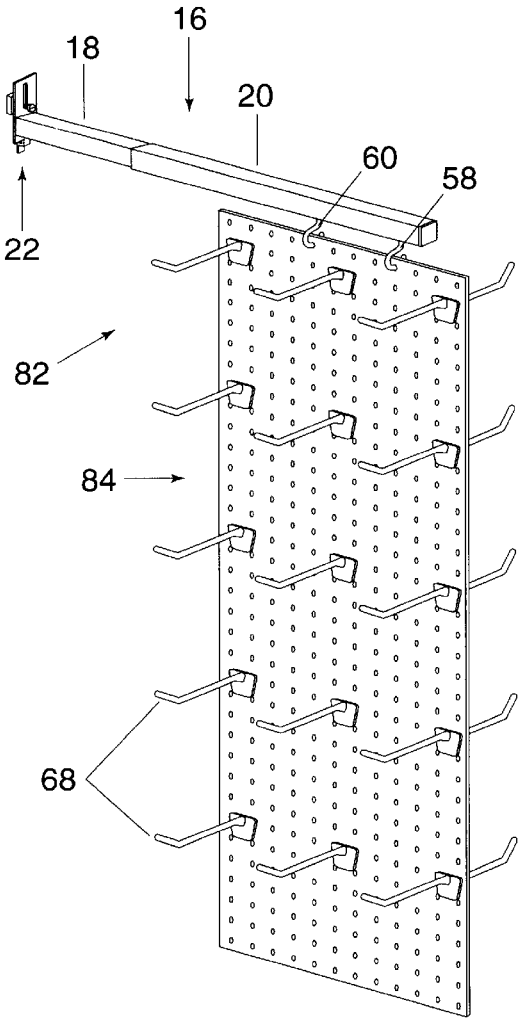
FIG. 3 is a still further variation of the first preferred embodiment and illustrating a differently shaped display member according to the present invention.
Figure 4:
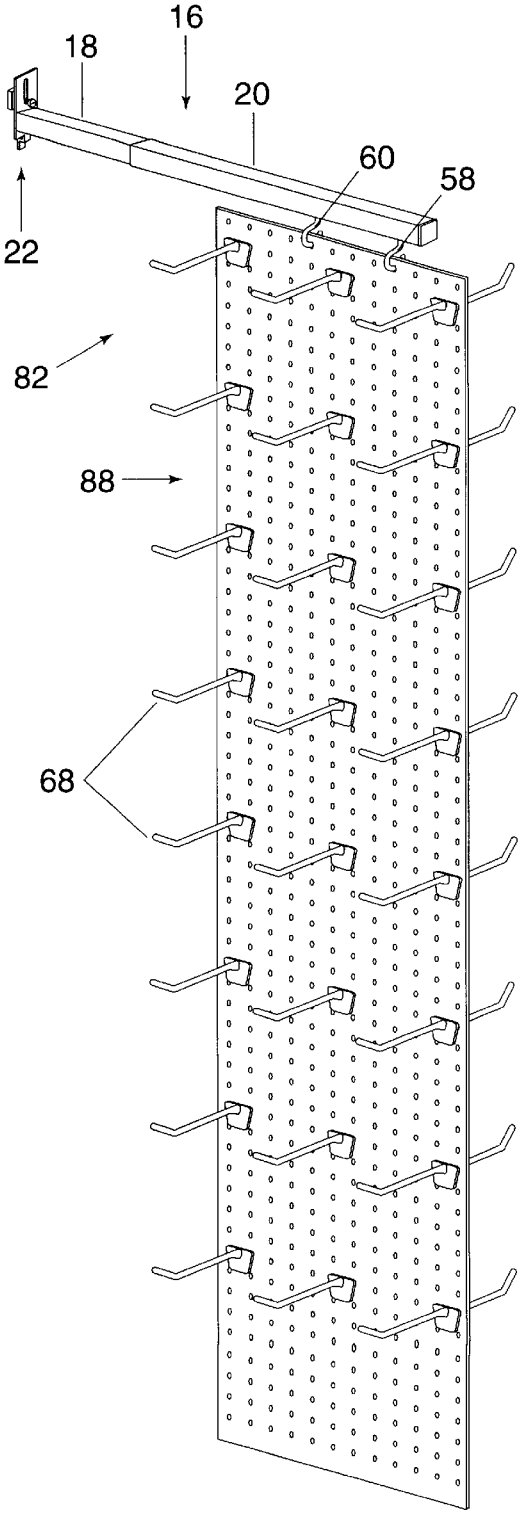
FIG. 4 is a yet further variation of the first preferred embodiment and illustrating a differently shaped display member according to the present invention.

Referring further to FIGS. 3 and 4, additional modifications of the first preferred embodiment are shown which are largely identical to each other, except as to dimension. Specifically, FIG. 3 illustrates a modification 82 of the merchandising display structure in which a display member 84 is substantially equal in length to the member illustrated at 56 in FIG. 1 and wider. Referring to FIG. 4, a further modification 86 illustrated of the merchandising display structure and which illustrates a display member 88 equal in length to that shown at 80 in FIG. 2 and again wider in dimension.

Figure 5:
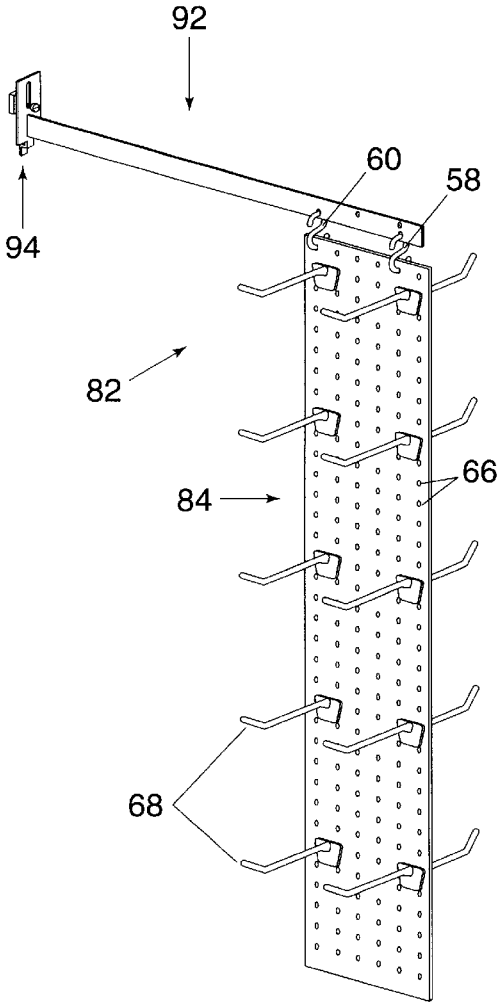
FIG. 5 is a view of a merchandising display assembly illustrating the display member substantially as shown in FIGS. 1–4 and further illustrating a fixed horizonally extending member.

Referring now to FIG. 5, a merchandising display assembly 90 is illustrated according to a further preferred variant and which again includes the elongate display member 56 as identically illustrated in FIG. 1. The only distinguishing difference in FIG. 5 is that a horizontally extending member 92 is formed as an integral one-piece, substantially flattened and planar shaped portion. A support portion is illustrated at 94 secured to a free end of the extending member 92 and is as substantially described with reference to the explanation provided in FIG. 15.

Figure 6:
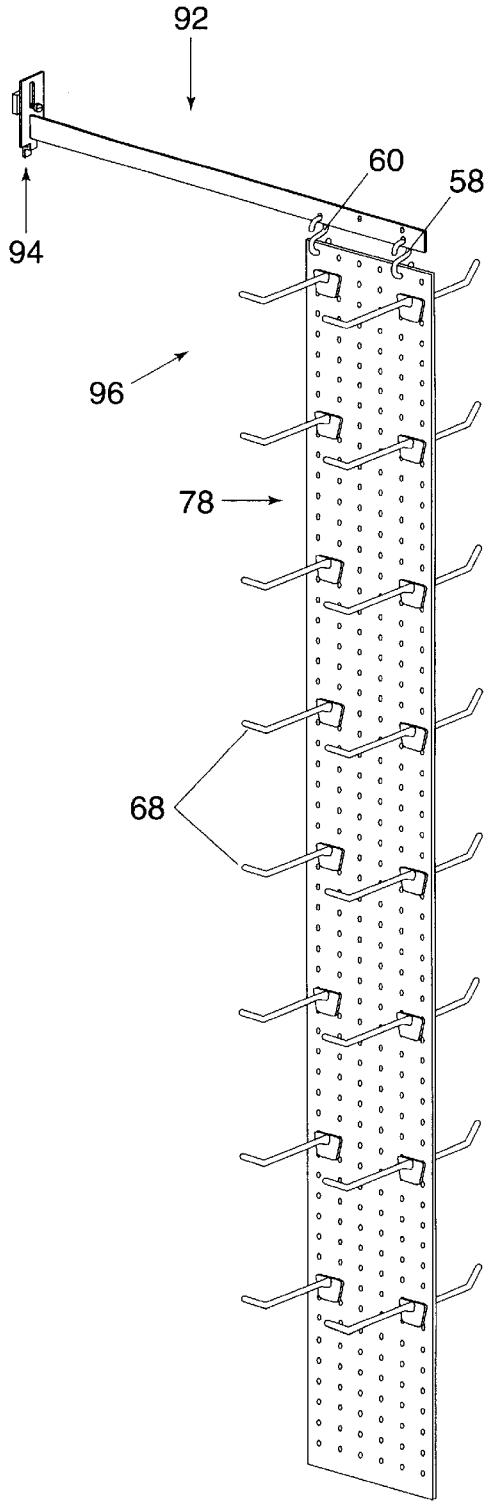
FIG. 6 is a further variation of the merchandising display assembly as substantially shown in FIG. 5 and including a differently shaped display member.
Figure 7:
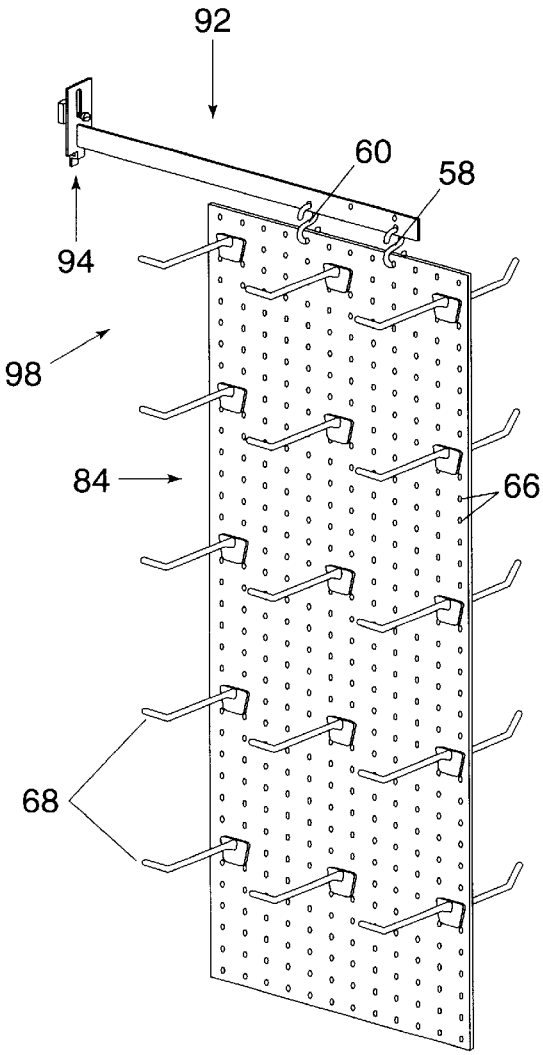
FIG. 7 is a still further variation of the merchandising display assembly as shown in FIG. 5 and according to the present invention.
Figure 8:
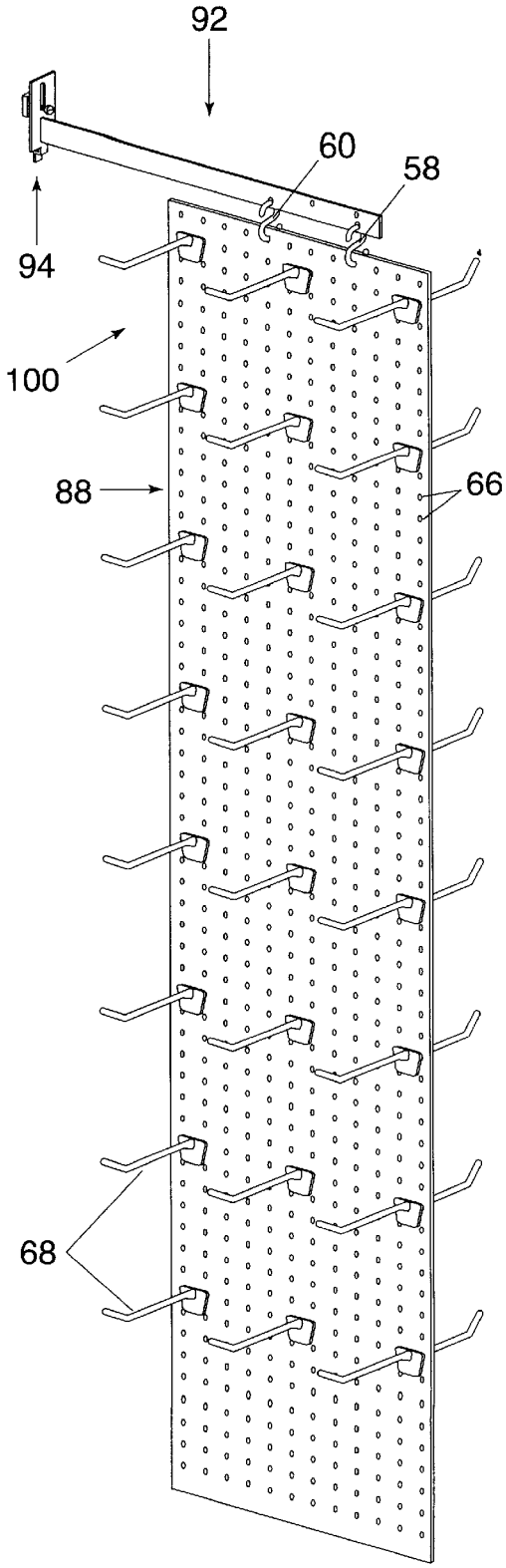
FIG. 8 is a yet further variation of the merchandising display assembly as shown in FIG. 5 and according to the present invention.

Referring to FIGS. 6, 7 and 8, additional variants of the embodiment illustrated at 90 in FIG. 5 are shown at 96, 98 and 100, respectively. The horizontally extending member 92 and support portion 94 is the same and the display members are shown again at 80, 84 and 88, respectively, as previously shown at FIGS. 2, 3 and 4.

Figure 9:
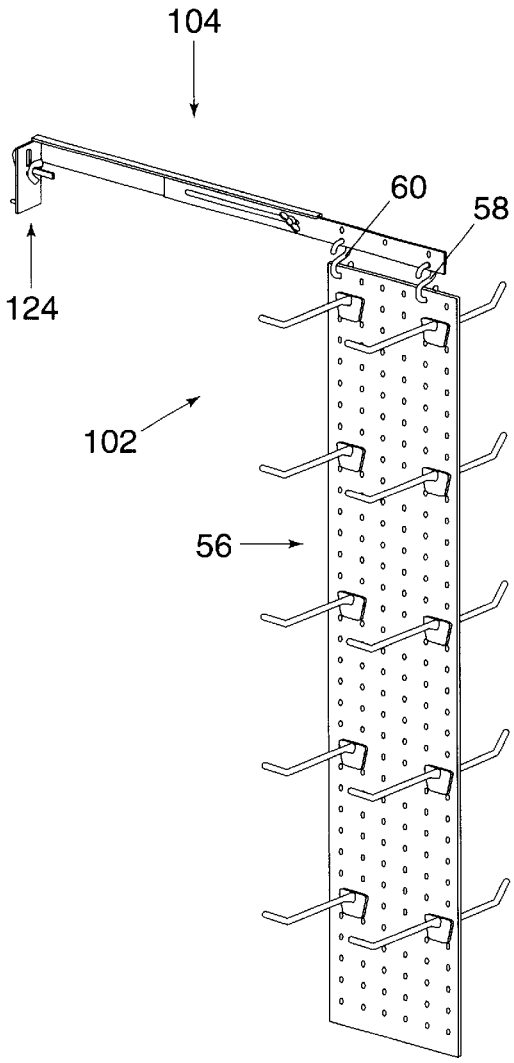
FIG. 9 is a perspective view of the merchandising display assembly according to the present invention again illustrating the elongated and flattened display member and further illustrating a horizontally extending member consisting of first and second planar shaped and axially extensible portions.

Referring to FIG. 9, a display assembly 102 is shown which again includes the display member 56 of FIGS. 1 and 5 and a further modification of a horizontally extending member 104. The member 104 is again shown in the enlarged sectional view of FIG. 13 and includes a first planar shaped portion 106 and a second axially extensible and planar shaped portion 108. An elongate slot 110 is formed along the second planar shaped portion 108 and is engaged by a bolt 112 (see phantom illustration) extending through an aligning aperture 114 in the first planar shaped portion 106. A wing nut 116 is selectively tightened upon establishing a desired overall axial length of the first and second planar shaped portions. Apertures formed in the terminating end of the second planar shaped portion 108, and as specifically shown at 118 and 120, are capable of receiving curved ends of the hooks 58 and 60 for suspending the appropriate display member.

Figure 13:
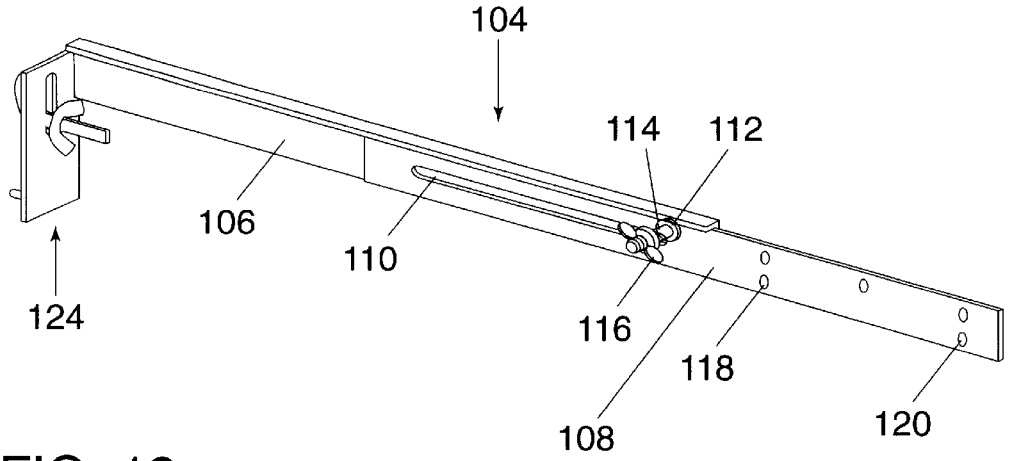
FIG. 13 is a sectional view of an axially adjustable and horizontally extending member according to a further preferred variant.
Figure 14:
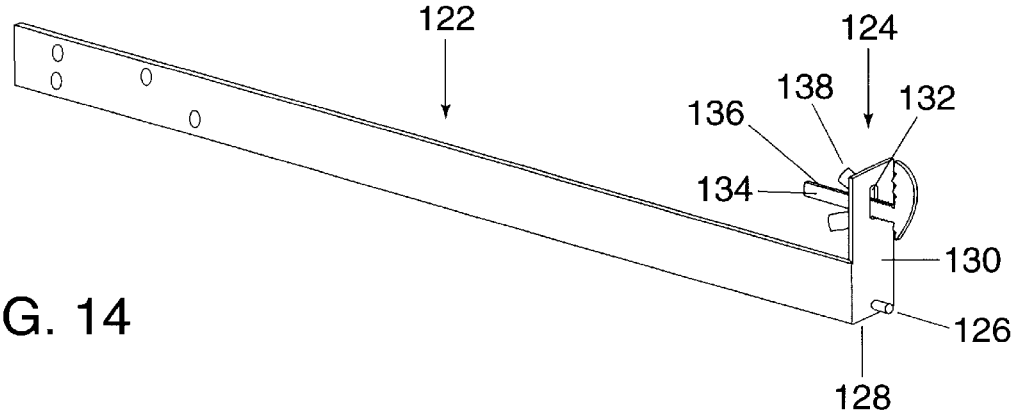
FIG. 14 is a view similar to that shown in FIG. 13 and illustrating in section a still further variant of a fixed horizontally extending member with support surface engaging portion.

Referring further to FIG. 14, a sectional view is shown at 122 of a fixed one-piece horizontally extending member, as opposed to the axially adjustable member 104 of FIG. 13. Both the adjustable member 104 of FIG. 13 and the fixed member 122 of FIG. 14 include a variation 124 of the support portion described in the single slotted backplate assembly of FIG. 15. Specifically, and referring best to the view of FIG. 14, an inwardly projecting tab 126 extends from a rear bottom edge 128 of plate shaped member 130 secured to the free end of the horizontally extending member 122. A vertical slotted portion 132 is formed along a predetermined length of the plate shaped member 130 and a flattened and elongated adjustable gripping portion 134 having an upper serrated edge 136 projects through the slotted portion 132 and a first selected linearly extending slot of the backplate (as shown by single slot backplate of FIG. 15. A wing nut 138 setting upon a projecting end of the gripping portion 134 is rotatable and, upon seating of the inwardly projecting tab 126 within a further selected linearly extending slot, engages a rear surface backplate 130.

Figure 10:
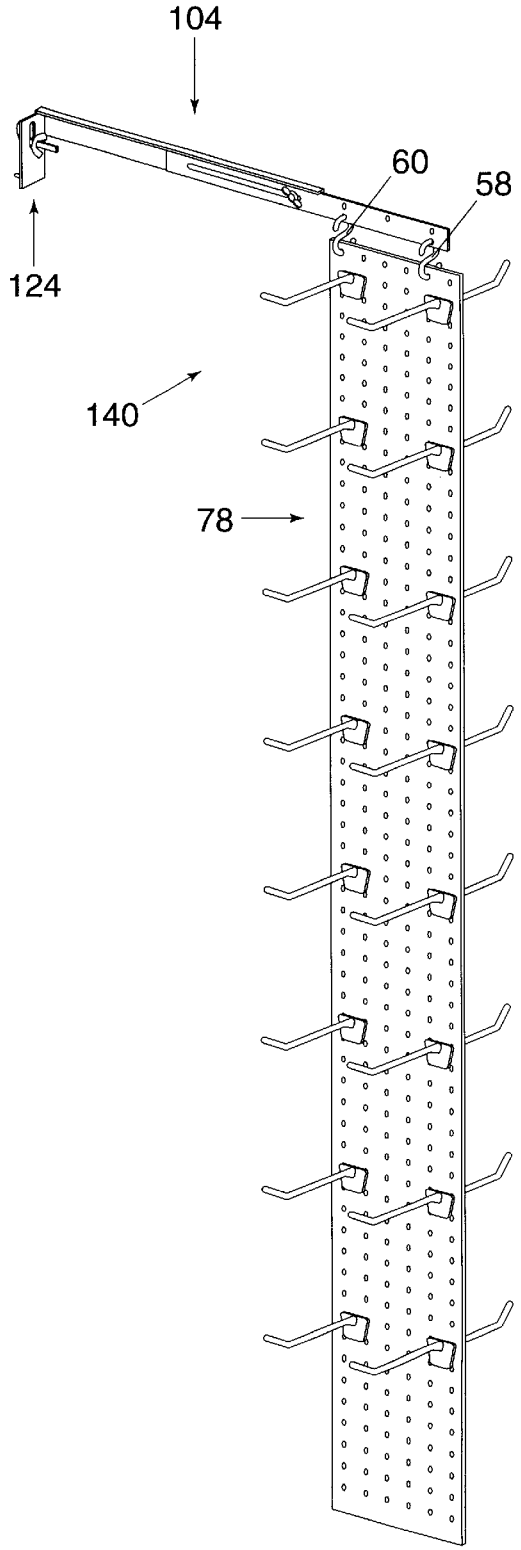
FIG. 10 is a view similar to that shown in FIG. 9 and further illustrating a variation of the horizontally extending member according to the present invention.
Figure 11:
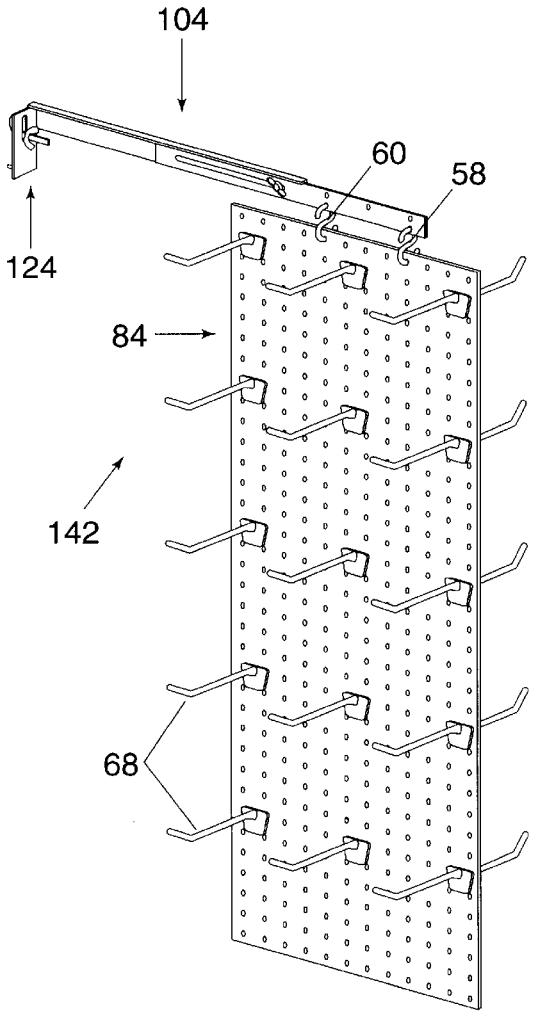
FIG. 11 is a view similar to that shown in FIG. 9 and further illustrating another variation of the horizontally extending member according to the present invention.
Figure 12:
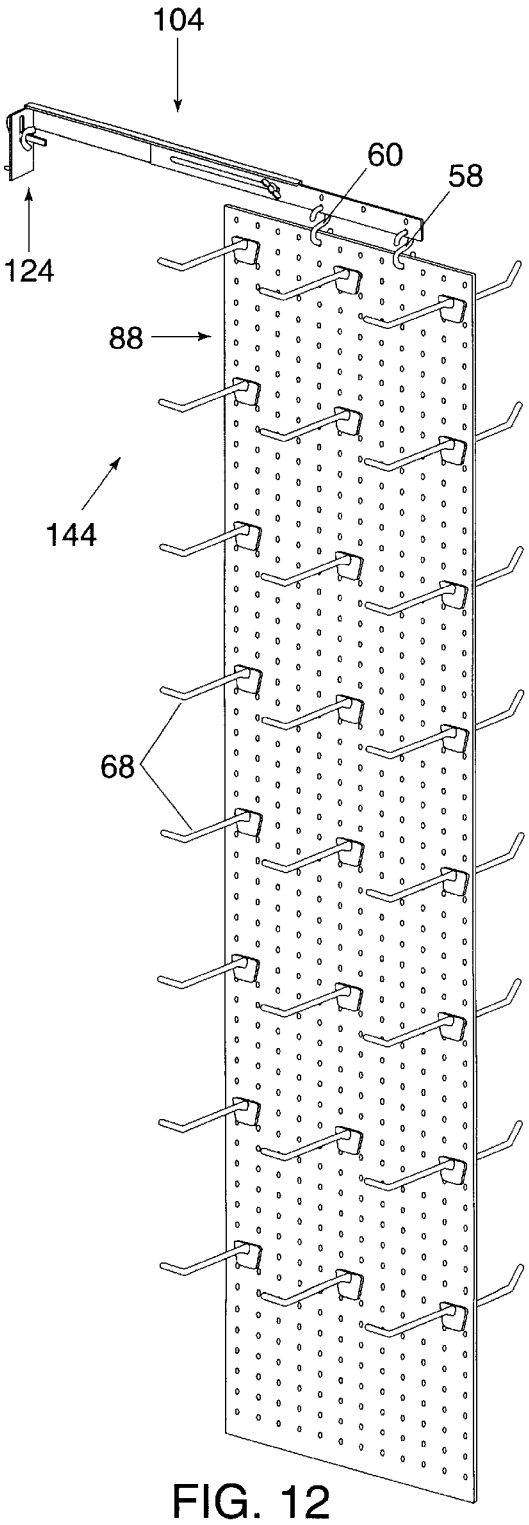
FIG. 12 is another view similar to that shown in FIG. 9 and further illustrating another variation of the horizontally extending member according to the present invention.

Referring further to the illustrations of FIGS. 10, 11 and 12, variants 140, 142 and 144 are illustrated, respectively, each of which includes an axially adjustable horizontally extending member 104 and alternately configured mounting means illustrated by support portion 124. As with FIGS. 5–8, identical display members 78, 84 and 88 are again shown.

Figure 16:
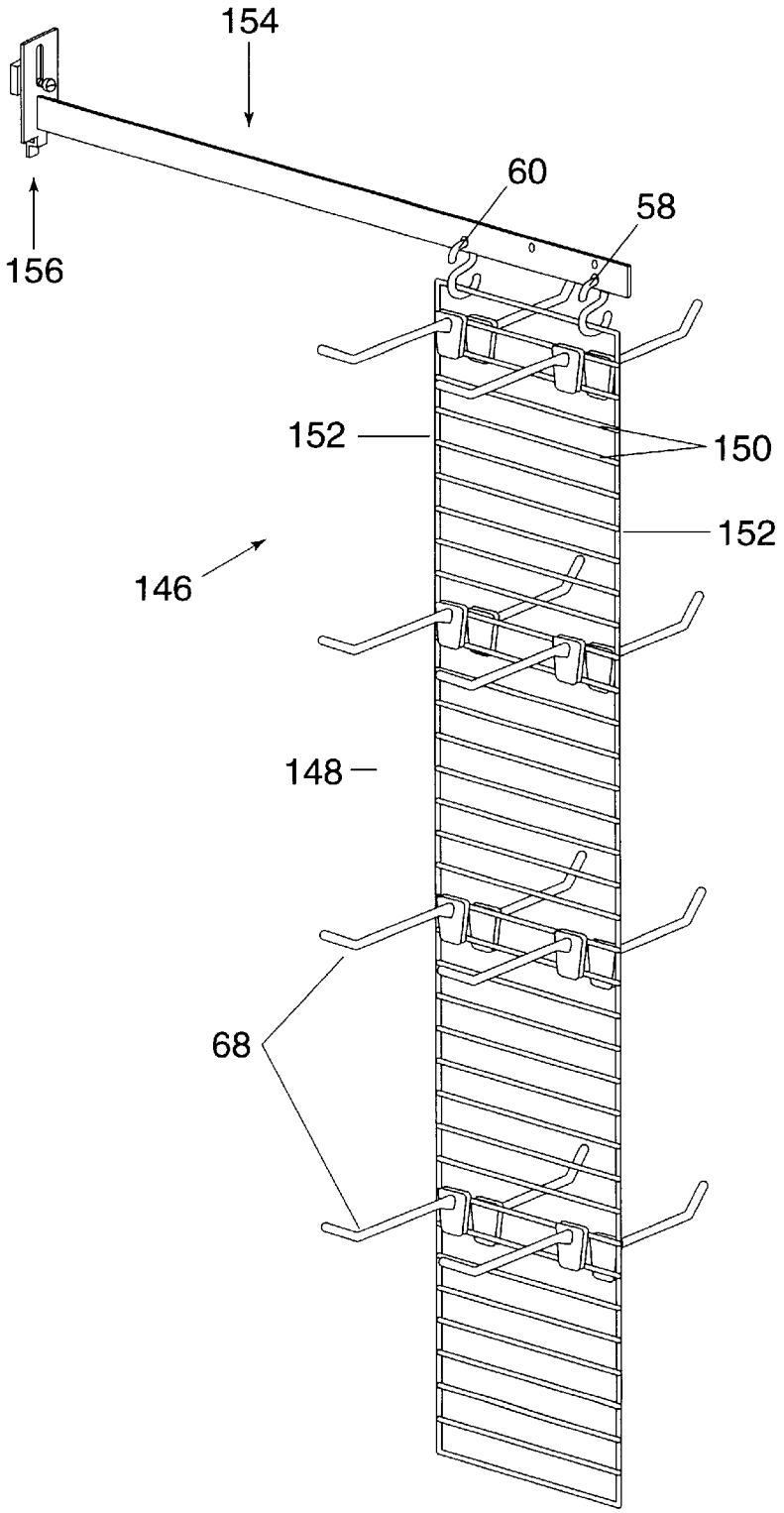
FIG. 16 is a perspective view of the merchandising display structure according to a further preferred embodiment of the present invention and illustrating the display member having the grid pattern of interlocking wire elements so as to establish first and second faces.

Finally, with reference to FIG. 16, a display assembly 146 includes a grid pattern 148 constructed of a pattern of interlocking wire elements such as at 150 and 152. The construction of the grid pattern 148 which makes up the elongate display are further an improvement over the prior art in that it provides a significantly increased volume of merchandise carrying capability beyond that which has been previously possible in the art. The positioning of the grid 148 is further accomplished in the illustrated embodiment by a fixed horizontally extending member 154 which is substantially as also shown in FIG. 14 with the exception that a single slotted backplate assembly 156 as described as described in FIG. 15 is again illustrated. A plurality of hanger portions 68 are provided which are engageable between succeeding pairs of spaced apart and horizontally extending wire elements 150 of the grid pattern 148.

It is understood that the preceding discussion cover only the most preferred embodiments of the merchandising display assembly according to the present invention and that other shapes and designs may also be employed. Having described my invention, other additional embodiments will become apparent to those skilled in the art to which it pertains according to the appended claims:

I claim:

1. A merchandising display assembly mounted to and extending from an upwardly extending support surface, said display assembly comprising:

a horizontally extending member including at least one elongated portion;

a support portion attaching to a free end of said elongated portion, said support portion including mounting means which engage with the upwardly extending support surface to mount said horizontal member in an extending fashion from the support surface; and an elongated and substantially flattened display member and means for suspending said display member in freely swinging and vertically extending fashion from an opposite end of said horizontally extending member, said display member including receiving means at spaced intervals along said display member for receiving a volume of merchandise, said display member further including first and second opposite faces defined by a substantially solid material, said receiving means further including a plurality of individual apertures formed through said solid material between said faces and at selected intervals and for receiving merchandise on both said first and second faces.

2. The merchandising display assembly as described in claim 1, said inner and outer telescoping portions each having a hollow interior and said axially adjusting means further comprising a plurality of spaced apart holes which are placed along said outer telescoping portion, a spring loaded pin projecting through a hole in said inner telescoping member and being selectively aligned with one of said plurality of holes in said outer telescoping portion to slidingly engage said inner tubular member with said outer tubular member.

3. The merchandising display assembly as described in claim 2, said inner and outer telescoping portions being polygonal shaped in cross section.

4. The merchandising display assembly as described in claim 3, said inner and outer telescoping portions being rectangular shaped in cross section.

5. The merchandising display assembly as described in claim 1, said horizontally extending member further comprising at least one substantially flattened, elongate and planar shaped portion.

6. The merchandising display assembly as described in claim 5, further comprising a first planar shaped portion and a second axially extensible planar shaped portion, an elongate slot formed along said second planar shaped portion and engaged by a bolt extending through an aligning aperture in said first planar shaped portion, a wing nut being selectively tightened upon establishing a desired overall axial length of said first and second planar shaped portions.

7. The merchandising display assembly as described in claim 1, said support portion further comprising a plate shaped member welded to said free end of said horizontally extending member.

8. The merchandising display assembly as described in claim 7, the vertical support surface being an elongate single slotted backplate having a plurality of spaced apart and linearly extending slots, said mounting means further comprising a downwardly and forwardly stepped portion extending from a bottom edge of said plate shaped member, said mounting means further comprising a vertical slotted portion formed along a predetermined length of said planar shaped member, a screw projecting through said slotted portion and a first selected linearly extending slot of said backplate, a square shaped nut setting upon a projecting end of said screw and subsequently rotatable, upon seating said downwardly and forwardly stepped portion within a further selected linearly extending slot, to engage a rear surface of the backplate.

9. The merchandising display assembly as described in claim 7, the vertical support surface being an elongate single slotted backplate having a plurality of spaced apart and linearly extending slots, said mounting means further comprising an inwardly projecting tab extending from a rear bottom edge of said plate shaped member, said mounting means further comprising a vertical slotted portion formed along a predetermined length of said plate shaped member, a flattened and elongate adjustable gripping portion having an upper serrated edge projecting through said slotted portion and a first selected linearly extending slot of said backplate, a wing nut setting upon a projecting end of said gripping portion and subsequently rotatable, upon seating said inwardly projecting tab within a further selected linearly extending slot, to engage a rear surface of the backplate.

10. The merchandising display assembly as described in claim 1, said elongated and substantially flattened display member further comprising at least one grid pattern of interlocking wire elements establishing first and second faces.

11. The merchandising display assembly as described in claim 10, said receiving means further comprising a plurality of hanger portions engageable with selected pairs of horizontally extending and spaced apart wire elements.

12. The merchandising display assembly as described in claim 1, said receiving means further comprising a plurality of hanger portions selectively engageable within pairs of said apertures formed through said display member.

13. The merchandising display assembly as described in claim 1, said means for suspending further comprising at least one hook extending from an underside surface of said horizontally extending member proximate said opposite and extending end, said hook engaging a selected location of said display member proximate its upper edge.

14. The merchandising display assembly as described in claim 13, further comprising first and second spaced apart hooks engaging first and second selected locations of said display member.

15. A merchandising display assembly mounted to and extending from an upwardly extending support surface, said display assembly comprising:

a horizontally extending member including at least one elongated portion, the horizontally extending member further including a first tubular shaped and inner telescoping portion and a second tubular shaped and outer telescoping portion, said inner telescoping portion being received within said outer telescoping portion;

a support portion attaching to a free end of said elongated portion, said support portion including mounting means which engage with the upwardly extending support surface to mount said horizontal member in an extending fashion from the support surface, said outer telescoping portion projecting from an end of said inner telescoping portion opposite said support portion; and an elongated and substantially flattened display member and means for suspending said display member in freely swinging and vertically extending fashion from an opposite end of said horizontally extending member, said display member including receiving means at spaced intervals along said display member for receiving a volume of merchandise.

* * * * *